US007399431B2

(12) United States Patent
Abadie et al.

(10) Patent No.: US 7,399,431 B2
(45) **Date of Patent: *Jul. 15, 2008**

(54) MATERIAL FOR NEUTRON SHIELDING AND FOR MAINTAINING SUB-CRITICALLY, PROCESS FOR ITS PREPARATION AND ITS APPLICATIONS

(75) Inventors: Pascale Abadie, Fontenay-le-Peury (FR); Eric Malandin, Auzebosc (FR); Martine Valiere, Puteaux (FR)

(73) Assignee: Cogema Logistics, Montigny le Bretonneux (FR)

( * ) Notice: Subject to any disclaimer, the term of this patent is extended or adjusted under 35 U.S.C. 154(b) by 116 days.

This patent is subject to a terminal disclaimer.

(21) Appl. No.: 10/687,551

(22) Filed: Oct. 15, 2003

(65) Prior Publication Data

US 2004/0127599 A1 Jul. 1, 2004

(30) Foreign Application Priority Data

Oct. 25, 2002 (FR) ..... 02 13369

(51) Int. Cl.
*G21C 7/06* (2006.01)
*G21F 1/10* (2006.01)
*G21F 1/00* (2006.01)

(52) U.S. Cl. ..... 252/478; 523/136

(58) Field of Classification Search ..... 252/478
See application file for complete search history.

(56) References Cited

U.S. PATENT DOCUMENTS 2,796,411 A * 6/1957 Zirkle et al. ..... 250/518.1
2,961,415 A 11/1960 Axelrad
3,133,887 A * 5/1964 Alliegro et al. ..... 252/478
3,261,800 A * 7/1966 Collins ..... 523/136
3,361,684 A * 1/1968 Chvatal ..... 252/478
3,609,372 A * 9/1971 Vogel ..... 250/518.1
3,829,532 A 8/1974 Meloy
3,879,318 A 4/1975 Forsyth
4,134,937 A 1/1979 Cass
6,548,570 B1 4/2003 Lange
6,605,817 B1 8/2003 Nihei
6,797,972 B2 * 9/2004 Kamoshida et al. ..... 250/507.1

(Continued)

FOREIGN PATENT DOCUMENTS

DE 199 55 192 A1 5/2001

(Continued)

OTHER PUBLICATIONS

Derwent abstract ACC-NO: 1985-008236, for FR 2546331-A (Nov. 23, 1984).*

(Continued)

*Primary Examiner*—Joseph D. anthony
(74) *Attorney, Agent, or Firm*—Christensen O'Connor Johnson Kindness PLLC

(57) ABSTRACT

The invention relates to a material for neutron shielding and for maintaining sub-criticality, and a process for preparation of this material and applications of the said material.

The material comprises a matrix based on a vinylester resin, at least one polyamide and an inorganic filler capable of slowing and absorbing neutrons.

Applications: manufacturing of neutron shields in packagings for transport, interim storage and/or ultimate storage of radioactive materials, particularly packagings for new nuclear fuels.

16 Claims, 1 Drawing Sheet

U.S. PATENT DOCUMENTS

| | | | | |
|---|---|---|---|---|
| 2005/0001205 | A1* | 1/2005 | Malalel et al. | 252/478 |
| 2005/0012054 | A1* | 1/2005 | Valiere | 250/505.1 |

FOREIGN PATENT DOCUMENTS

| | | | | |
|---|---|---|---|---|
| EP | 0 108 622 | A2 | | 5/1984 |
| EP | 0 119 781 | A1 | | 9/1984 |
| EP | 0 372 758 | A1 | | 6/1990 |
| EP | 0 628 968 | A1 | | 12/1994 |
| FR | 2092848 | A | | 1/1972 |
| FR | 2505080 | A | | 11/1982 |
| FR | 2 546 331 | A1 | | 11/1984 |
| GB | 859696 | | | 1/1961 |
| GB | 1 049 890 | A | | 11/1966 |
| JP | 55-119099 | A | * | 9/1980 |
| JP | 59 126296 | A | | 7/1984 |
| JP | 60 065032 | A | | 4/1985 |
| WO | WO95/28440 | A1 | | 10/1995 |

OTHER PUBLICATIONS

Derwent abstract AN 1980-76219C, for JP 55-119099-A.*
Encyclopedia of Polymer Science and Engineering, (1989, John Wiley & Sons, Inc, New York), vol. 17, pp. 393,425-441.*
USPTO obtained translation of Ozawa et al. (JP 55-119099).*
USPTO obtained translation of Bochard (FR 2546331-A1).*
Hawley's Condensed Chemical Dictionary, 14th ed., John Wiley & Sons, Inc., New York, © 2001, pp. 39, 155-157, 688, 753, and 1192.

* cited by examiner

MATERIAL FOR NEUTRON SHIELDING AND FOR MAINTAINING SUB-CRITICALLY, PROCESS FOR ITS PREPARATION AND ITS APPLICATIONS

DESCRIPTION

1. Technical Field

This invention relates to a material for neutron shielding and for maintaining sub-criticality, and a process for preparation of this material and applications of it.

The material according to the invention has the special feature that it is remarkably suitable for slowing and absorbing neutrons, while having a particularly low density.

Therefore, it can represent an ideal material for making neutron shields in packagings for transport, interim storage and/or ultimate storage of radioactive materials, and particularly new nuclear fuel assemblies, in other words assemblies that have not yet been irradiated, like those composed of plutonium-base oxides that emit neutrons rather than gamma radiation.

2. State of Prior Art

Materials designed to form neutron shields in packaging for transport, interim storage and/or ultimate storage of nuclear fuels must have a number of properties.

Firstly, they must be capable of slowing and very efficiently capturing neutrons, particularly to keep these packagings sub-critical, in other words to prevent neutrons formed in them from causing a nuclear chain reaction.

They must also have a good resistance to aging at relatively high temperatures since the presence of nuclear fuels in the packagings generates high temperatures (of the order of 150° C. during normal transport conditions).

They must also have a low thermal conductivity, but the conductivity must be high enough so that heat released by nuclear fuels within the packagings can be dissipated.

They must also have good fire resistance, which assumes that they are self-extinguishing, in other words they stop burning as soon as the flames have gone out.

Finally, it is desirable that these materials should have a relatively low density so that their presence in the packagings does not increase their weight any more than necessary.

The materials should have a high content of hydrogen and should contain an inorganic compound, for example based on boron that is efficient in capturing neutrons, in order to slow and capture neutrons.

Thus, for example:

FR-A-2 546 331 [1] proposes a neutron shielding material that comprises polyethylene or polypropylene balls retained in a binder composed of a polyester resin or an aluminous cement, a stable hydrate such as alumina trihydrate, and a compound containing boron (colemanite or boron carbide).

EP-A-0 628 968 [2] describes a neutron shielding material obtained from a mix between a thermosetting resin and a high-density inorganic filler. The thermosetting resin may be a phenol, epoxy, cresol, xylene or urea resin or an unsaturated polyester, while the inorganic filler may be a heavy metal (lead, tungsten, etc.), a lanthanide (europium, gadolinium, etc.) or uranium.

GB-A-1 049 890 [3] describes cast articles and neutron protection coatings obtained from a copolymerisable mix of an unsaturated polyester and an ethylene monomer, in which either the acid part of the polyester is partly derived from boric acid, or the ethylene monomer is partly a boric acid ester, or the unsaturated polyester and/or the ethylene monomer contain boron hydride or boron chloride.

These materials are not fully satisfactory. In particular, they do not have sufficient resistance to thermal aging due to the nature of the hydrogenated polymers contained in them, and their density is too high.

Thus for example, the material described in EP-A-0 628 968 has a density of at least 2.

SUMMARY OF THE INVENTION

Within the context of his research work, the Applicant has developed a material that combines excellent properties for neutron shielding and maintaining sub-criticality, with very satisfactory self-extinguishing and thermal properties, particularly in terms of resistance to thermal aging.

This material comprises a matrix based on a vinylester resin such as a novolac resin within which are dispersed firstly a hydrogenated inorganic compound capable of slowing neutrons such as alumina hydrate, and secondly an inorganic boron compound such as zinc borate, capable of capturing them.

Its remarkable properties are explained particularly by the fact that vinylester resins, apart from being rich in hydrogen and consequently capable of very efficiently slowing neutrons, have low thermal conductivity and excellent thermal stability.

However, its density is equal to at least 1.6 and it is usually between 1.65 and 1.9.

Therefore, the Inventors set themselves the objective of finding a material with properties similar to the properties of this material based on a vinylester resin, but with a lower density.

This purpose is achieved by the invention that proposes a material for neutron shielding and maintaining sub-criticality, in which the material comprises a matrix based on a vinylester resin, at least one polyamide and an inorganic filler capable of slowing and absorbing neutrons.

The Inventors observed that by incorporating a compound chosen from within the polyamides family (most members of this family have a relatively high content of hydrogen, low density (of the order of 1 to 1.2 depending on the polyamide) and a high melting temperature) into a vinylester resin-based matrix, together with an inorganic filler capable of slowing and absorbing neutrons, a material can be obtained with properties that are as just as attractive as the properties of the said material based on a vinylester resin, or even better in terms of neutron shielding and maintaining sub-criticality, but with a density of between 1.3 and 1.6.

According to this invention, the term "polyamide" refers equally well to a homopolyamide derived from the reaction between amino and acid groups belonging to the same molecule, or a copolyamide resulting from the reaction between amino and acid groups belonging to different molecules.

According to the invention, the polyamide may equally well be an aliphatic, semi-aromatic or aromatic polyamide.

However, it is preferred to use an aliphatic polyamide, since aliphatic polyamides are richer in hydrogen than semi-aromatic and aromatic polyamides, and consequently capable of making a greater contribution to slowing of neutrons by the material.

The polyamide is preferably chosen from among the group composed of 11 polyamides ($C_{11}H_{21}ON$), 12 polyamides ($C_{12}H_{23}ON$) and 6–12 polyamides ($C_{12}H_{22}O_2N_2$), which have densities equal to 1.04, 1.02 and 1.07 respectively and melting temperatures equal to 187, 178 and 212° C. respectively.

These polyamides are available in the form of powders with different size gradings, for example from ATOFINA company that markets them under the brands Rilsan® D (11 polyamide) and Orgasol® (6, 12, 6–12 polyamides).

Also according to the invention, the choice of the polyamide is guided firstly by its chemical composition (which controls its hydrogen content), its density and melting temperature, and also by its size grading as a function of conditions for use of the material, and particularly the viscosity required from this material before the vinylester resin is polymerized.

Thus for example, Rilsan® D80 polyamides that are in the form of fine powders (Ø=75–85 μm) are used to obtain mixes with a lower viscosity than mixes obtained using Orgasol®, which are ultrafine powders (Ø=5–60 μm) and are therefore easier to pour into a mould.

Different types of vinylester resin may be used in the composition of the material.

Preferably, a vinylester resin will be used derived from the reaction caused by the addition of a carboxylic acid with an epoxy resin.

In particular, this carboxylic acid may be acrylic acid or methacrylic acid, methacrylic acid being preferred since it has a higher hydrogen content, while the macromolecular pattern of the epoxy resin may be of the bisphenol A or novolac type.

Thus, the vinylester resin is preferably chosen from the group composed of bisphenol A-type epoxyacrylate and epoxymethacrylate resins, novolac-type epoxyacrylate and methacrylate resins, and epoxyacrylate and epoxymethacrylate resins based on halogenated bisphenol A.

The bisphenol A-type epoxyacrylate and epoxy-methacrylate resins respond to the following formula (I)

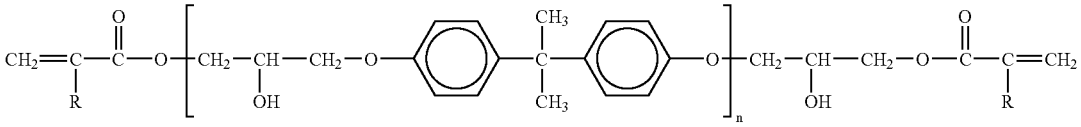

in which R represents a hydrogen atom or a methyl group.

The novolac-type epoxyacrylate or epoxymethacrylate resins are defined by the following formula (II):

(II)

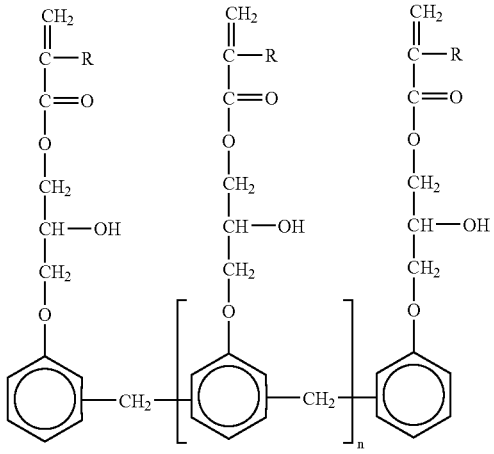

in which R represents a hydrogen atom or a methyl group.

Halogenated epoxyacrylate or epoxymethacrylate resins based on bisphenol A are defined by the following formula (III):

(III)

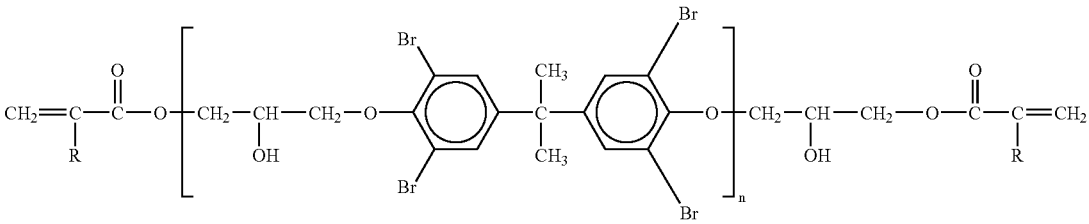

in which R represents a hydrogen atom or a methyl group.

As a variant, a non-epoxy vinylester resin obtained from an isophthalic polyester and an urethane can also be used in a material according to the invention, for example responding to the following formula (IV):

(IV)

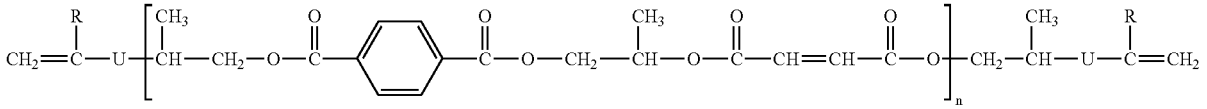

where R represents a hydrogen atom or a methyl group, while U represents an urethane group.

Preferably, the vinylester resin is an epoxyacrylate or epoxymethacrylate resin of the novolac type.

According to the invention, the material also comprises an inorganic filler capable of slowing and absorbing neutrons.

This inorganic filler preferably comprises at least one hydrogenated inorganic compound and at least one inorganic boron compound.

Advantageously, the hydrogenated inorganic compound is chosen from the group composed of alumina hydrates and magnesium hydroxide ($Mg(OH)_2$), while the inorganic boron compound is chosen from the group composed of boric acid ($H_3BO_3$), colemanite ($Ca_2O_{14}B_6H_{10}$), zinc borates ($Zn_2O_{14,5}H_7B_6$, $Zn_4O_8B_2H_2$, $Zn_2O_{11}B_6$), boron carbide ($B_4C$), boron nitride (BN) and boron oxide ($B_2O_3$).

Preferably, the hydrogenated inorganic compound is alumina hydrate with formula $Al_2O_3$, while the inorganic boron compound is zinc borate with formula $Zn_2O_{14.5}H_7B_6$ or boron carbide.

The material according to the invention may also comprise an anti-shrinkage agent such as a poly(vinyl acetate) capable of preventing it from shrinking during polymerization of the vinylester resin.

It may also comprise a hydrogenated organic filler such as melamine, to improve its self-extinguishing properties.

According to the invention, the quantity of hydrogenated inorganic compound is chosen such that, considering the hydrogen quantities also provided by the vinylester resin and the polyamide, the atomic concentration of hydrogen in the material will preferably be between about $4.5\times10^{22}$ and $6.5\times10^{22}$ at/cm$^3$.

Similarly, the quantity of the inorganic boron compound is chosen such that the material preferably has an atomic concentration of boron between about $8\times10^{20}$ and $3\times10^{21}$ at/cm$^3$.

Very satisfactory materials have been obtained from mixes in which the vinylester resin and the polyamide account for between 30 and 45% and between 10 to 30% respectively of the total mass of this resin, this polyamide and inorganic filler being capable of slowing and absorbing neutrons.

The material according to the invention may be preferred by setting of a mix containing its different constituents, this setting resulting from polymerization of the vinylester resin.

Another purpose of the invention is a process for preparation of this material including the following steps:

- mix the vinylester resin, the polyamide, the inorganic filler capable of slowing and absorbing neutrons, with at least one resin polymerization accelerator,
- add at least one resin polymerization catalyst to this mix,
- degas the mix under a vacuum,
- pour the mix obtained into a mould,
- allow it to set in the mould.

Commercially available vinylester resins are in the form of solutions in which the solvent is a vinyl solvent, and the quantity of solvent present in these resins is usually sufficient so that the various constituents of the material are easy to mix and the resulting consistency is suitable.

However, a vinyl solvent could be added while mixing the said constituents if necessary.

Examples of vinyl solvents that could be used include styrene, vinyltoluene, divinylbenzene, methylstyrene, methyl acrylate, methyl methacrylate or an allylic derivative such as diallyl phthalate.

Preferably, the solvent used will be the same solvent as for vinylester resin, and particularly styrene, since this is the most frequently used solvent for the preparation of vinylester resins.

Accelerators and polymerization catalysts are chosen from along the compounds normally used to obtain polymerization of vinylester resins.

In particular, accelerators may consist of divalent cobalt salts such as cobalt naphthenate or octoate, and aromatic tertiary aminos such as dimethylaniline, dimethylparatoluidine and diethylaniline.

In particular, catalysts may for example be organic peroxides, for example:

- peroxides derived from cetone such as methylethylcetone peroxide, acetylacetone peroxide, methylisobutylcetone peroxide, cyclohexanone peroxide and cumen hydroperoxide;
- diacyl peroxides, for example benzoyl peroxide, possibly in combination with aromatic tertiary aminos such as dimethylaniline, diethylaniline and dimethylparatoluidine, and
- dialkyl peroxides such as dicumyl peroxide and ditertiobutyl peroxide.

One or several additives can also be added to the mix, such as a resin polymerization inhibitor, a surfactant or an anti-shrinkage agent.

Acetylacetone and tertiobutylcathecol are other examples of polymerization inhibitors that can be used.

The process according to the invention may be used as follows.

The vinylester resin, polyamide, the inorganic filler capable of slowing and absorbing neutrons (for example inorganic hydrogenated and boron compounds) and the polymerization accelerator are mixed at ambient temperature until a perfectly uniform mix is obtained.

The polymerization catalyst is added and after homogenization, the resulting mix is degassed under a vacuum (less than 0.01 MPa).

Ideally, the viscosity of this mix must not exceed 300 Poises, so that it can easily be poured into a mould.

After degassing, the mix is poured into the required mould where it sets, due to polymerization of the vinylester resin, and is transformed into an insoluble material. This is a radical type polymerization and it is highly exothermal. The setting time may vary depending on pour conditions (temperature, catalyst, accelerator content, etc.). Thus, the gel time may be varied by varying the percentages of catalyst and accelerator. The gel time varies from 20 minutes to 2 hours.

According to the invention, the mould used for setting the mix may be composed of a compartment of a packaging for transport, interim storage and/or ultimate storage of radioactive products. This packaging may in particular comprise several peripheral components into which the mix is poured.

Another purpose of the invention is packaging for transport, interim storage and/or ultimate storage of radioactive materials that comprises at least one shield formed from a material like that described above.

Preferably, this packaging is designed to transport a new nuclear material such as a fuel composed of a plutonium-based oxide.

Other special features and advantages of the invention will become clearer after reading the following description related to an example production of a material according to the invention-and an example demonstration of its properties, and that is given for illustrative purposes and is in no way limitative, with reference to the attached drawing.

DETAILED PRESENTATION OF AN EMBODIMENT OF A MATERIAL ACCORDING TO THE INVENTION

Figure 1:
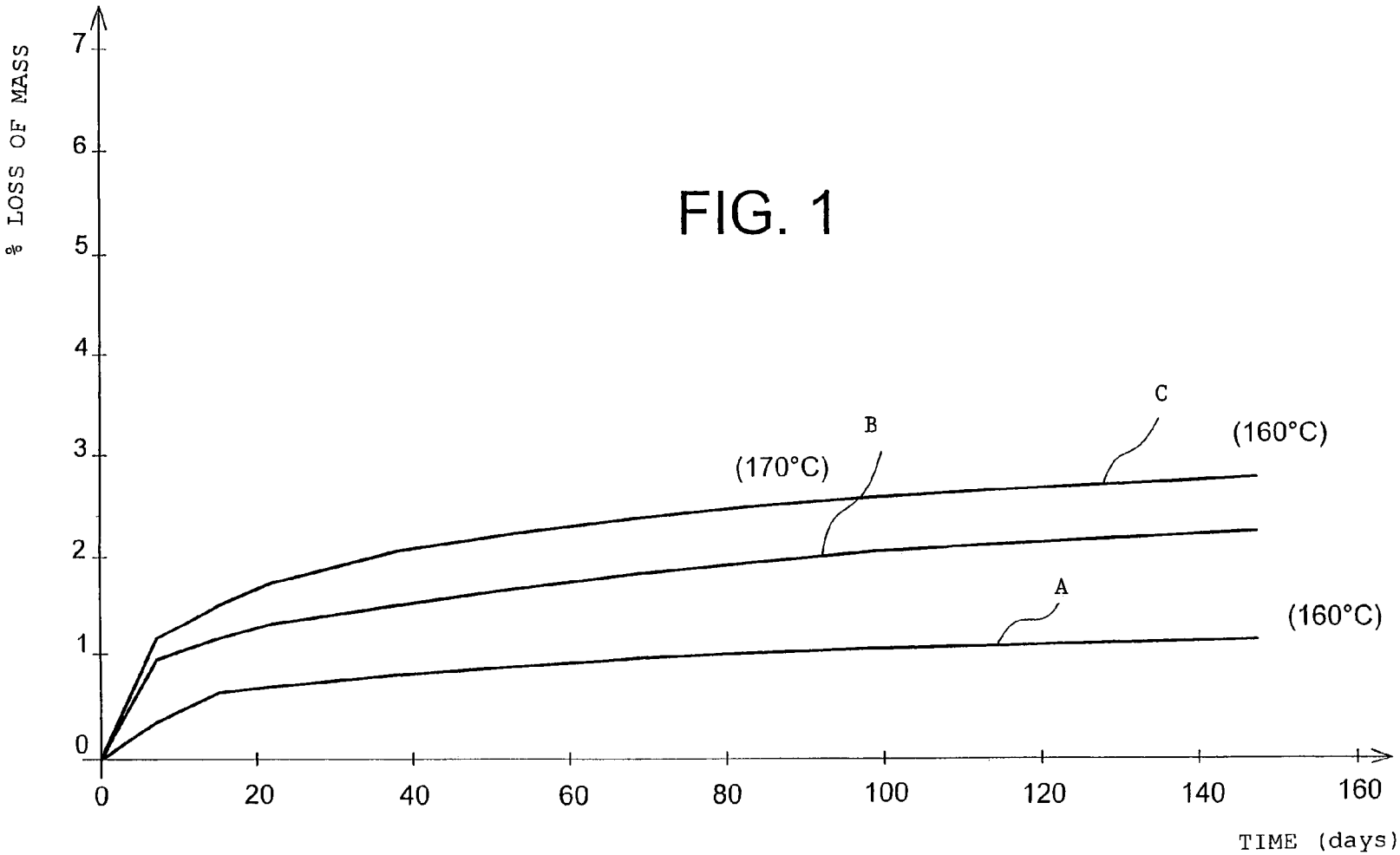
FIG. 1 shows the variation with time of the loss of mass (expressed as a percentage) of a material according to the invention when it is kept at 160° C. (curve A) and at 170° C. (curve B), and the loss of mass observed for a reference material held at 160° C. (curve C).

The mix is prepared:

40% by mass of this mix being a novolac-type resin (Derakane Momentum® D470-300-DOW CHEMICAL);

20% by mass of this mix being an 11 polyamide (Rilsan® D 80-ATOFINA);

38% by mass of this mix being an alumina hydrate $Al_2O_3$ (SH 150/01-PECHINEY);

2% by mass of this mix being a boron carbide with size grading between 45 and 75 μm (WACKER); and 1% by mass of this mix being a polymerization accelerator (NL 49P-AKZO).

A polymerization catalyst (Butanox® M50-AKZO) is added to this mix, at a content of 1% by mass of this mix.

The mix is then degassed for three minutes under a vacuum, and this mix is then poured into a mould composed of a compartment of the packaging used for transport of nuclear fuels.

The gel time is 25 minutes at 20° C.

The following are measured:

the density of this material using the conventional weighing in air/weighing in water technique, its hydrogen and boron contents, its vitreous transition temperature (Tg) by differential enthalpic analysis (DSC 30-METTLER), using a temperature rise rate of 10° C./min., its thermal expansion coefficient (α) by TMA 40 (METTLER), using a temperature rise rate of 10° C./min., its specific heat (Cp) by calorimetry, for temperatures varying from 40 to 180° C., and its thermal conductivity (λ) for temperatures between 20 and 170° C.

The results of these measurements are shown in Table 1.

Table 1 also shows the density, hydrogen and boron contents, the vitreous transition temperature (Tg), the coefficient of thermal expansion (α), the specific heat (Cp) and the thermal conductivity (λ) of a material hereinafter referred to as the "reference material" formed after setting of a mix of the following constituents (25 minutes at 20 C.), for comparison purposes:

32% by mass of this mix being the novolac-type vinylester resin of the Derakane Momentum® 470-300, 62% by mass of this mix being the alumina hydrate SH 150/01, and 6% by mass of this mix being a zinc borate $Zn_2O_{14.5}H_7B_6$ (Firebrake ZB-BORAX), plus the accelerator NL 49P (0.9% by mass of the resin) and the catalyst Butanox® M50 (1.5% by mass of the resin).

TABLE 1

| | Material | |
|---|---|---|
| | Material according to the invention | Reference material |
| Density | 1.43 | 1.79 |
| Hydrogen content | | |
| % by mass | 6.80 | 4.80 |
| atomic [C] (at/cm$^3$) | $5.47 \times 10^{22}$ | $5.1 \times 10^{22}$ |
| Boron content | | |
| % by mass | 1.45 | 0.89 |
| atomic [C] (at/cm$^3$) | $1.21 \times 10^{21}$ | $8.92 \times 10^{20}$ |
| Tg (° C.) | 131 | 130 |
| α (K$^{-1}$) | | |
| before Tg | $131 \times 10^{-6}$ | $37 \times 10^{-6}$ |
| after Tg | ND* | $109 \times 10^{-6}$ |
| Cp (J/g · K) | | |
| minimum | 1.37 | 1.07 |
| maximum | 2.15 | 1.65 |
| λ (W/m · K) | | |
| minimum | 0.47 | 0.80 |
| maximum | 0.58 | 0.85 |

*ND = Not determined

Table 1 shows that the density of the material according to the invention is significantly lower than the density of the reference material that does not contain any polyamide (1.43 compared with 1.79).

It also has significantly higher hydrogen and boron contents than the reference material.

Thus, although it is lighter, its performances in terms of neutron shielding and maintenance of sub-criticality, are better.

Thermal aging tests of the material according to the invention are also carried out, by keeping samples of this material measuring 35×25×95 mm$^3$ in two chambers heated to 160° C. and 170° C. respectively for 5 months, and monitoring the loss of mass of these samples with time.

The results of these tests are given in FIG. 1 (curves A and B), in which the ordinate axis represents the loss of mass of the material expressed as a percentage, while the abscissa axis represents the time expressed in days. This figure also shows the variation of the loss of mass observed during time when samples of the reference material also measuring 35×25×95 mm$^3$ are kept in a chamber heated to 160° C. (curve C).

FIG. 1 shows that the loss of mass of the material according to the invention is significantly lower than loss of mass of the reference material, even when it is kept at a higher temperature (170° C. compared with 160° C.). Therefore its thermal stability is better than the reference material.

Fire behavior tests are also carried out by placing blocks of material according to the invention with a diameter of 240 mm and a thickness of 60 mm, either directly in contact with the flame of a torch at a temperature of 800° C., or in contact with a 1 mm thick steel plate in contact with the torch flame, for half an hour.

In both cases, the material according to the invention obviously self-extinguishes as soon as the torch is removed.

The invention claimed is:

1. A set material for neutron shielding and for maintaining sub-criticality, comprising:

a matrix based on a vinylester resin selected from the group consisting of bisphenol A-type epoxy(meth)acrylate resins, novolac-type epoxy(meth)acrylate resins, epoxy (meth)acrylate resins based on halogenated bisphenol A, and resins obtained from an isophthalic polyester and a urethane, at least one polyamide, and an inorganic filler capable of slowing and absorbing neutrons, the inorganic filler comprising at least one hydrogenated inorganic compound and at least one inorganic boron compound.

2. Material according to claim 1, in which the polyamide is an aliphatic polyamide.

3. Material according to claim 2, in which the polyamide is chosen from among 11 polyamides, 12 polyamides 6–12 polyamides and mixes of them.

4. Material according to claim 1, in which the vinylester resin is a novolac-type epoxy(meth)acrylate resin.

5. Material according to claim 1, in which the hydrogenated inorganic compound is chosen from the group consisting of alumina hydrates and magnesium hydroxide.

6. Material according to claim 1, in which the inorganic boron compound is chosen from the group consisting of boric acid, colemanite, zinc borates, boron carbide, boron nitride and boron oxide.

7. Material according to claim 1, in which the hydrogenated inorganic compound is alumina hydrate with formula $Al(OH)_3$.

8. Material according to claim 1, in which the inorganic boron compound is zinc borate with formula $Zn_2O_{14.5}H_7B_6$ or boron carbide.

9. Material according to claim 1, with an atomic concentration of hydrogen between about $4.5\times10^{22}$ and $6.5\times10^{22}$ at/cm$^3$.

10. Material according to claim 1, with an atomic concentration of boron between about $8\times10^{20}$ and $3\times10^{21}$ at/cm$^3$.

11. Material according to claim 1, in which the vinylester resin accounts for between 30 and 45% of the total mass of this resin, the polyamide and inorganic filler being capable of slowing and absorbing neutrons.

12. Material according to claim 11, in which the polyamide accounts for between 10 to 30% of the total mass of the vinylester resin, the polyamide and inorganic filler being capable of slowing and absorbing neutrons.

13. Material according to claim 1, with a density of between 1.3 and 1.6.

14. Process for preparation of a set material for neutron shielding and for maintaining sub-criticality comprising a matrix based on a vinylester resin selected from the group consisting of bisphenol A-type epoxy(meth)acrylate resins, novolac-type epoxy(meth)acrylate resins, epoxy(meth)acrylate resins based on halogenated bisphenol A, and resins obtained from an isophthalic polyester and a urethane, at least one polyamide and an inorganic filler capable of slowing and absorbing neutrons, the inorganic filler comprising at least one hydrogenated inorganic compound and at least one inorganic boron compound, comprising:

(a) mix the vinylester resin, the polyamide, and the inorganic filler comprising at least one hydrogenated inorganic compound and at least one inorganic boron compound capable of slowing and absorbing neutrons, with at least one resin polymerization accelerator, (b) add at least one resin polymerization catalyst to this mix, (c) degas the mix tinder a vacuum, (d) pour the mix obtained into a mould, and (e) allow the mix to set in the mould.

15. Process according to claim 14, in which the mould is composed of a compartment of a packaging for transport, interim storage and/or ultimate storage of radioactive products.

16. Packaging for transport, interim storage and/or ultimate storage of radioactive materials, comprising at least one shield formed from the material as defined in any one of claims 1-3, 4, and 5-13.

* * * * *

UNITED STATES PATENT AND TRADEMARK OFFICE

CERTIFICATE OF CORRECTION

PATENT NO. : 7,399,431 B2
APPLICATION NO. : 10/687551
DATED : July 15, 2008
INVENTOR(S) : P. Abadie et al.

It is certified that error appears in the above-identified patent and that said Letters Patent is hereby corrected as shown below:

| COLUMN | LINE | ERROR |
|---|---|---|
| Pg. 1, col. 2 | Primary Examiner | "Joseph D. anthony" should read --Joseph D. Anthony-- |
| 10 (Claim 14, line 19) | 31 | "tinder" should read --under-- |

Signed and Sealed this

Third Day of March, 2009

JOHN DOLL
*Acting Director of the United States Patent and Trademark Office*